United States Patent [19]

Fernandez et al.

[11] Patent Number: 4,592,217

[45] Date of Patent: Jun. 3, 1986

[54] MARKER ATTACHMENT FOR RAILROAD EQUIPMENT

[75] Inventors: Emilio A. Fernandez; Angel P. Bezos; Gregory C. Martin, all of Rockville, Md.

[73] Assignee: Pulse Electronics, Inc., Rockville, Md.

[21] Appl. No.: 731,351

[22] Filed: May 7, 1985

[51] Int. Cl.[4] ..... G01L 5/28

[52] U.S. Cl. ..... 73/129; 246/167 R

[58] Field of Search ..... 73/129; 303/86, DIG. 1; 213/75 R, 76, 77; 246/167 R

[56] References Cited

U.S. PATENT DOCUMENTS 4,487,060 12/1984 Pomeroy ..... 73/129

4,520,662 6/1985 Schmid ..... 73/129

*Primary Examiner*—Jerry W. Myracle

*Attorney, Agent, or Firm*—C. Lamont Whitham; W. Boswell Childs

[57] ABSTRACT

An improved attaching device is provided for securely mounting railroad signalling and monitoring equipment (10, 12) on the coupler (36) of a railroad car. A package including a supporting frame (22) to which the equipment is fastened by a draw pull (16) rests on the top surface of the coupler. The supporting frame includes a mounting bracket (32) having an integral rod (50) which extends through the flag hole in the coupler knuckle. The end of the rod projects beyond the bottom of the coupler so that it can be secured. In the second embodiment (FIGS. 8 and 9), the rod (111) has bifurcated extensions (116, 118) which serve to strengthen the supporting frame (80). This embodiment also includes shock absorbing elements (108, 110 and 122). In a third embodiment, a post (162) slidably carries a shaft or rod (188) that is retractable into a locking position with the coupler. A crank (176) is used to retract the shaft into a locking position. The crank carries a locking bar (234) which cooperates with locking members (230, 232) on the equipment package to secure the package in place. The three embodiments all feature top of coupler mounting in such manner that the railroad signalling and monitoring equipment is not damaged in the event that another coupler engages the coupler on which the package is mounted.

20 Claims, 18 Drawing Figures

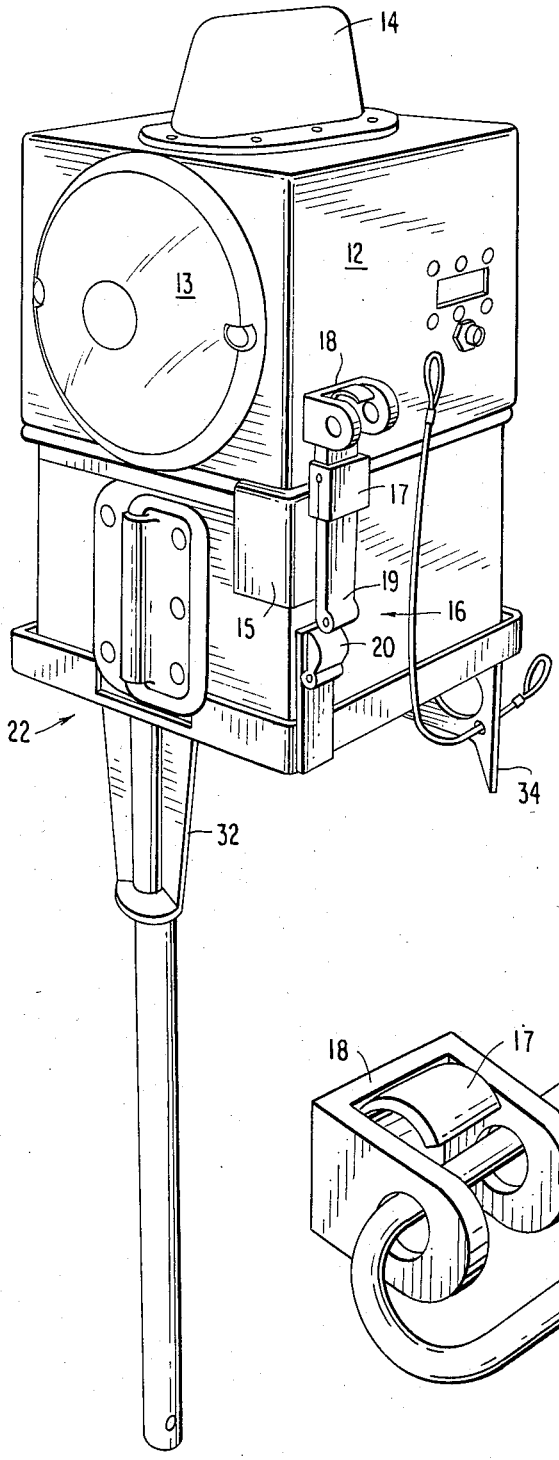
FIG. 1
FIG. 1A
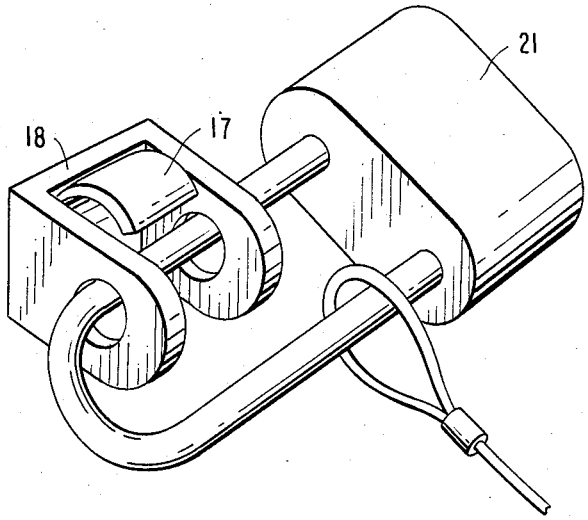

FIG. 7
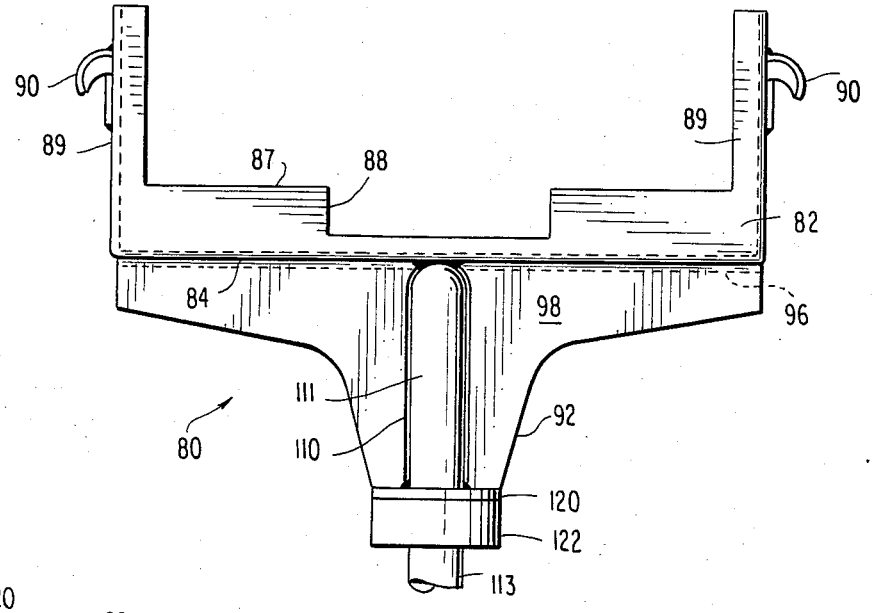
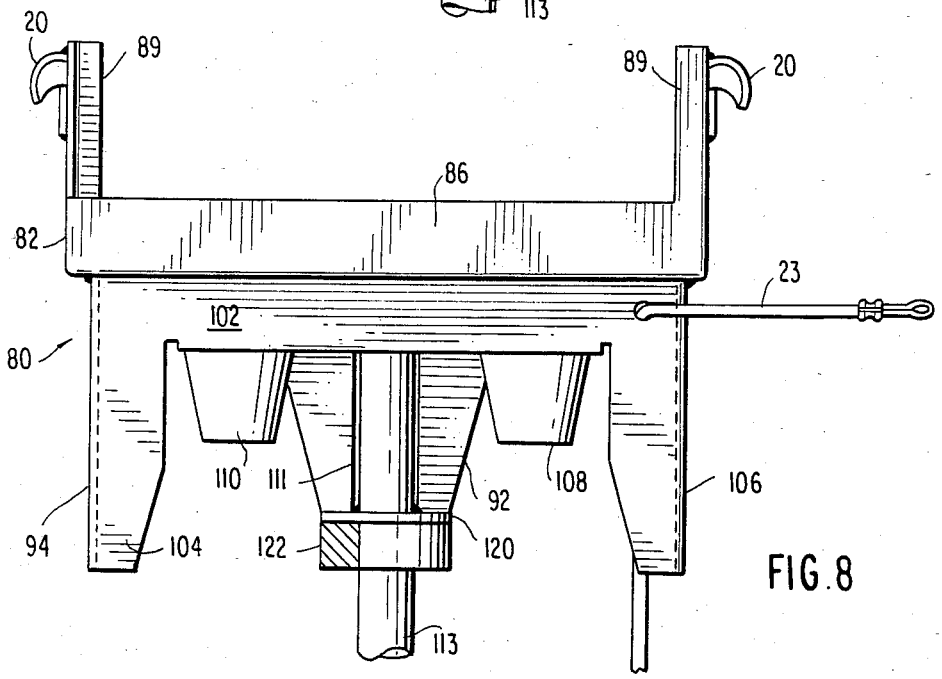
FIG. 8

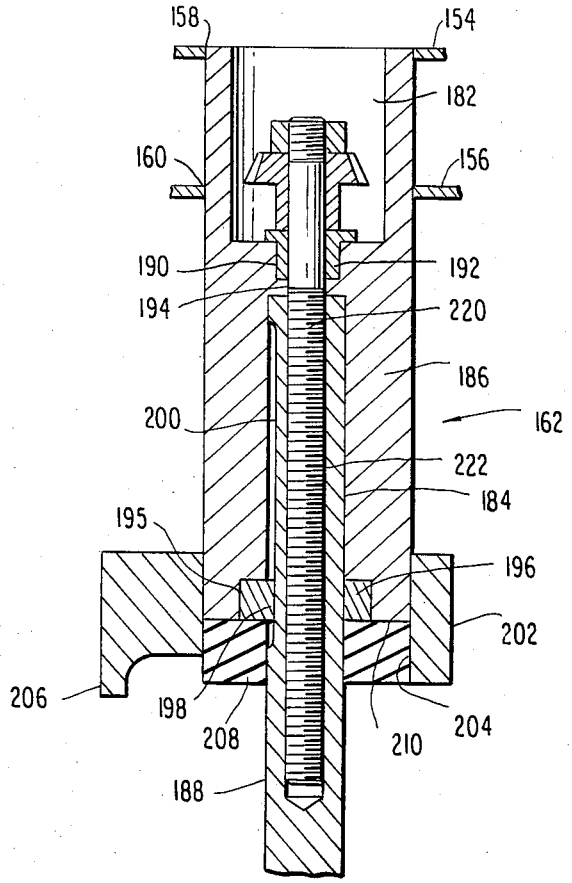
FIG. 14
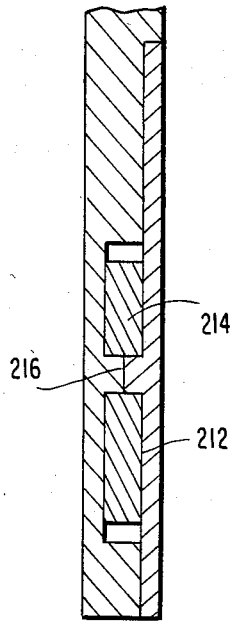

MARKER ATTACHMENT FOR RAILROAD EQUIPMENT

DESCRIPTION

1. Technical Field

The present invention relates to an attachment for securing marker light and telemetry equipment to railroad cars and, more particularly, to an attachment which is easily secured to and removed from the top of the coupling knuckle of the last car in a train, and which permits coupling when in place on the knuckle.

2. Description of the Prior Art

Railroad signalling and safety equipment of various kinds has been in use extensively for years. Early examples are shown in the following U.S. patents: U.S. Pat. No. 165,426 to Ray et al, U.S. Pat. No. 1,363,098 to Dysart et al, U.S. Pat. No. 1,716,546 to Fry, and U.S. Pat. No. 1,738,016 to Pehrson. More recent examples are shown in the following patents: U.S. Pat. Nos. 2,355,544 and 4,487,060 to McGowan and Pomeroy, respectively, French Pat. No. 891,312, and Russian Pat. No. 262,935. The patents to McGowan and Pomeroy and the Russian patent all show equipment mounted on a train coupler.

In recent years there has been a trend toward the use of end of train signalling and monitoring equipment, in place of cabooses, to meet train operating and safety requirements. The information monitored, which typically includes the air pressure of the air brake line, is communicated by a battery powered telemetry transmitter to the crew in the locomotive. In addition, a marker light is required at the end of the train, and this too is battery powered. The marker light must be mounted a specific height above the track and have a beam pattern that is well defined in terms of shape, light intensity and color.

For use with a cabooseless train, the end of train signalling and monitoring equipment can be assembled into a compact unit which may be conveniently mounted on the coupler of the last car in the train. The aforementioned patent to McGowan shows signalling equipment secured to the coupler of a caboose, and, while the patent to Pomeroy shows a monitoring and transmitting unit attached to the knuckle of the coupler of the last car of a train, the unit extends into the coupler opening. In the case of the present invention, the signalling and monitoring equipment must be easily removable and replaceable to allow efficient use in a train yard, yet once secured to the top of the coupler, must be provided with means to prevent the accidental or unauthorized removal of the equipment. In addition, equipment mounted at the rear of the train, particularly that mounted on the coupler of the last car must be protected from damage if another car is coupled or a pusher locomotive is used. Resort has previously been made to attaching end-of-train equipment to the side of the coupler to avoid damage.

SUMMARY OF THE INVENTION

It is therefore an object of the present invention to provide an improved means for mounting end-of-train signalling and monitoring equipment on the top of a railroad car coupler in a manner that utilizes the flag hole of the coupler yet avoids the posibility of damage to the equipment in the event another car is coupled to the coupler.

It is another object of the invention to provide a mounting and attaching means for end-of-train equipment which is both secure and premits easy removal and replacement, while allowing yard operations to be carried out without the risk of damage to the equipment.

A still further and more specific object of the invention is to provide a combination of a rechargeable battery, signalling and monitoring equipment mated with the battery, and a supporting frame in an assembled unitary package which can be securely mounted on, yet easily removable by authorized personnel from, the top of the coupler of a railroad car.

According to the invention, these and other advances over the prior art are achieved by assembling such individual units as, for example, a rechargeable battery, brake pressure monitoring equipment, telemetry transmitter and antenna, and a marker light arranged and fitted to each other in the necessary relationship for proper functioning of each of the individual units, and latching this equipment assembly to a supporting frame to provide a unitary package which is easily and securely mounted on the top of and removable from a railroad train car coupler, specifically the coupler at the end of a train. This package of equipment and supporting frame rests on the top of the coupler. The supporting frame includes a downwardly extending rod or post the lower end of projects through the flag hole in the coupler knuckle and may be used to retain the assembly in place on the knuckle. Thus, mounting of the train signalling and monitoring equipment is simply a matter of setting the equipment on the train coupler with the rod projecting through the vertical hole in the coupler knuckle. Portions of the supporting frame and/or the rod, i.e., post, contact the coupler to prevent the assembly from swiveling. The whole package is secured in place to prevent unauthorized removal from the coupler.

BRIEF DESCRIPTION OF THE DRAWINGS

The foregoing and other objects, aspects and advantages of the invention will be better understood from the detailed description of a preferred embodiment with reference to the drawings, in which:

FIG. 1 is an isometric view of an assembled package including signalling and monitoring equipment, a rechargeable battery and a frame and mounting bracket according to the invention;

FIG. 1A is an enlarged perspective view showing the details of parts of an arrangement for latching and securing the assembled package against unauthorized removal of parts;

FIG. 7 is a front elevation view showing a modified form of the top of the coupler mount and the front bracket of the mount;

FIG. 8 is a rear elevation view showing the frame and rear bracket of the mount of FIG. 7;

FIG. 14 is a vertical cross-sectional view of the mounting post and shaft of the embodiment shown in FIG. 12;

DETAILED DESCRIPTION OF THE PREFERRED EMBODIMENTS OF THE INVENTION

Figure 2:
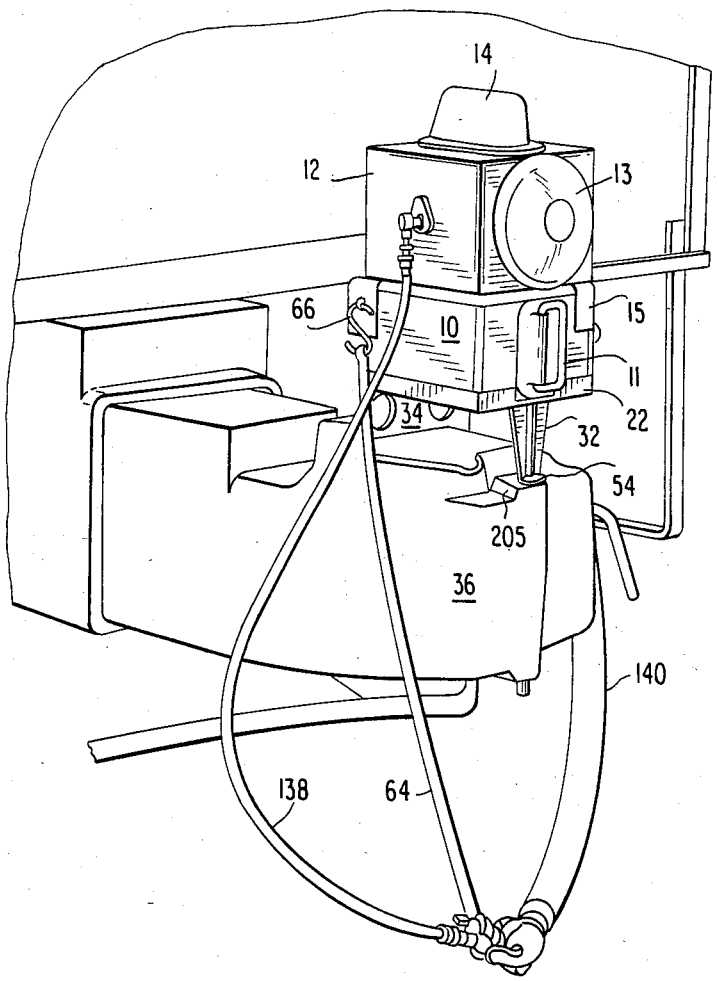
FIG. 2 is a perspective view of the assembled package mounted on top of the the coupler of a railroad car at the end of a train.

Referring now to the drawings, and more particularly to FIG. 1, there is shown a rechargeable battery pack 10 having a handle 11 which can be used to carry the battery by itself or to carry the entire assembled package. The battery back is provided with a multipin connector (not shown) which mates with a similar connector (also not shown) on the transmitter 12 unit. The transmitter unit 12 is provided with a strobe or similar marker light 13. A microwave antenna cover 14 is shown on the top of the transmitter unit. The case of the transmitter unit 12 is designed to have the same approximate shape and dimensions and to mate with the battery pack 10. To this end, the case of transmitter unit 12 is provided with one or more bottom corners with an extension projecting 15 which fits over the adjacent top corner of the case of the battery pack 10. Corner shaped projection 15 carries a latch 16 of the draw pull type having a pivoting hasp 17 that can be positioned in a keeper 18 on the transmitter case. Draw pull 16 also has an elongated buckle or clasp 19 which engages a hook 20 carried on a supporting frame generally indicated at 22. The battery pack 10 is inserted in the frame 22, and with the transmitter 12 plugged into the battery when the latch 16 is closed, the transmitter unit 12 is secured to the frame 22, thereby also securing the battery pack to the frame.

As may be seen in FIG. 2, a similar cornerlike projection to which a draw pull can be attached is provided at the diametrically opposite corner of the case of transmitter unit 12 so the opposite corners of the transmitter case can be fastened to the frame 22. The enlarged detail view of FIG. 1A shows how a padlock 21 may be employed to retain the hasp 17 of draw pull 16 in position in the keeper 18. For additional security against unauthorized removal of the battery pack and transmitter unit, a plastic covered armored cable 23 is provided. This cable has one end attached to the frame 22 and its other crimped end retained in the hasp of padlock 21.

Reference is now made to FIGS. 3 through 6 which show the details of the top of the coupler mount of FIGS. 1 and 2 by itself; i.e., with the equipment package removed. The frame 22 of the mount includes a tray 24 which has a bottom 25 and four vertical sidewalls 26, one of the latter being provided with a cut-out 28 to receive handle 11, enabling the battery pack 10 to be seated solidly on and retained in the tray. Vertical posts 30 to which the hook portions 20 of latches 16 are fastened are located at diametrically opposite corners of tray 24. Lightening (and drain) holes may be provided in the bottom 25 of the tray. Attached to the bottom of tray 24 at its front and rear edges are downwardly extending mounting brackets 32 and 34, respectively. For the sake of clarity, it is pointed out that terms front and rear are defined with respect to the package including the support frame unit. Thus, it is assumed that the package when removed from the coupler rests on its rear side; i.e., the side away from the marker light 13 and handle 11. Rear bracket 34 has its lower edge 35 and sides 37 shaped to contact, that is fit on and around, complementarily shaped portions of the top and sides of the coupler 36 shown in FIG. 2 in a manner that does not interfere with the coupler operation. In addition, bracket 34 is provided with pairs 38,40 and 42,44 of spaced vertical ribs having edges which are wedge-like as at 46 and 48, for example, to assist in providing more points of contact or bearing points with the coupler surface.

Front bracket 32 comprises rod 50 that fits into the flag hole in the coupler knuckle and projects beyond the bottom surface of the knuckle. Rod 50 has an opening 52 near its lower end which may receive the hasp of a padlock, as in FIG. 2. A washer 54 attached to rod 50 at an appropriate distance from the bottom of tray 24 provides a foot or flange-like surface that engages and bears on the coupler surface in the vicinity of the flag hole. A plurality of vertical rib-like members 56 attached to the washer 54, the rod 50 and the bottom of tray 24 provide rigidity for mounting bracket 32.

Figure 3:
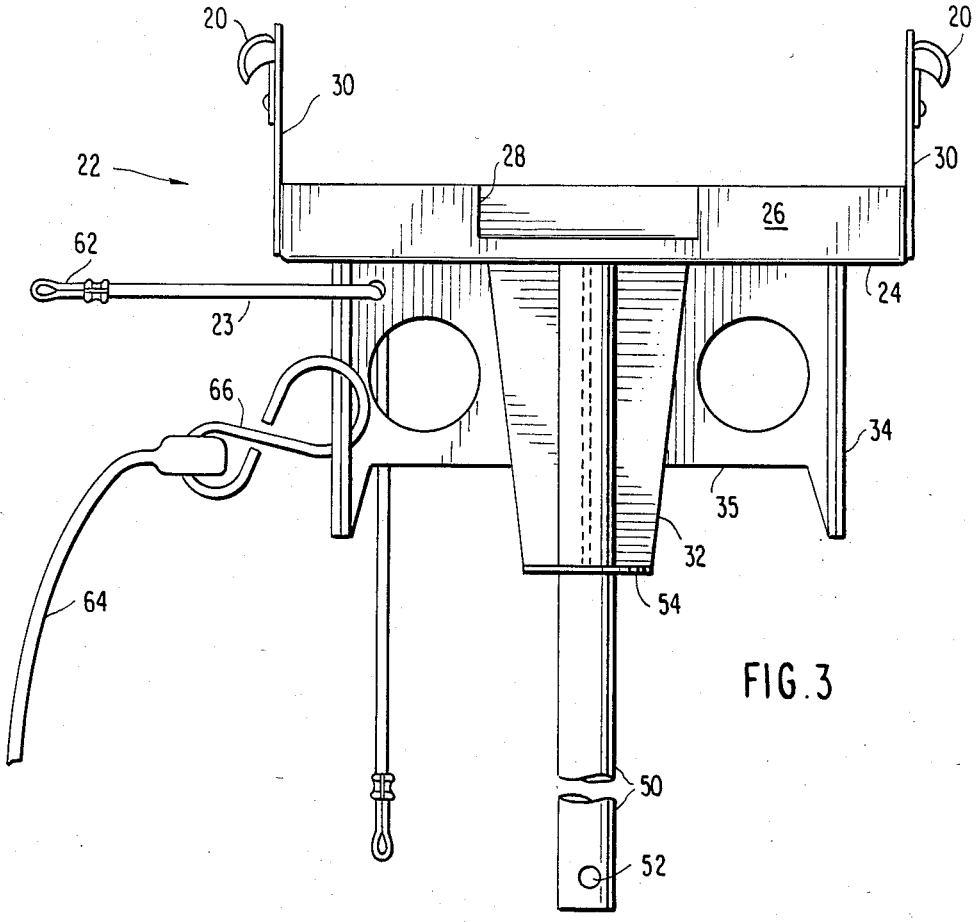
FIG. 3 is a front view in elevation showing details of the embodiment of the top of the coupler mount of FIGS. 1 and 2 with the equipment package removed.
Figure 4:
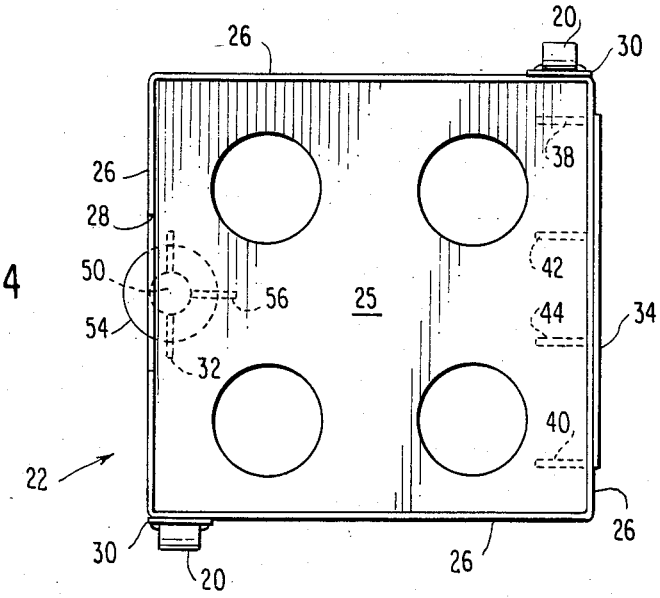
FIG. 4 is a plan view of the embodiment of FIG. 3.
Figure 5:
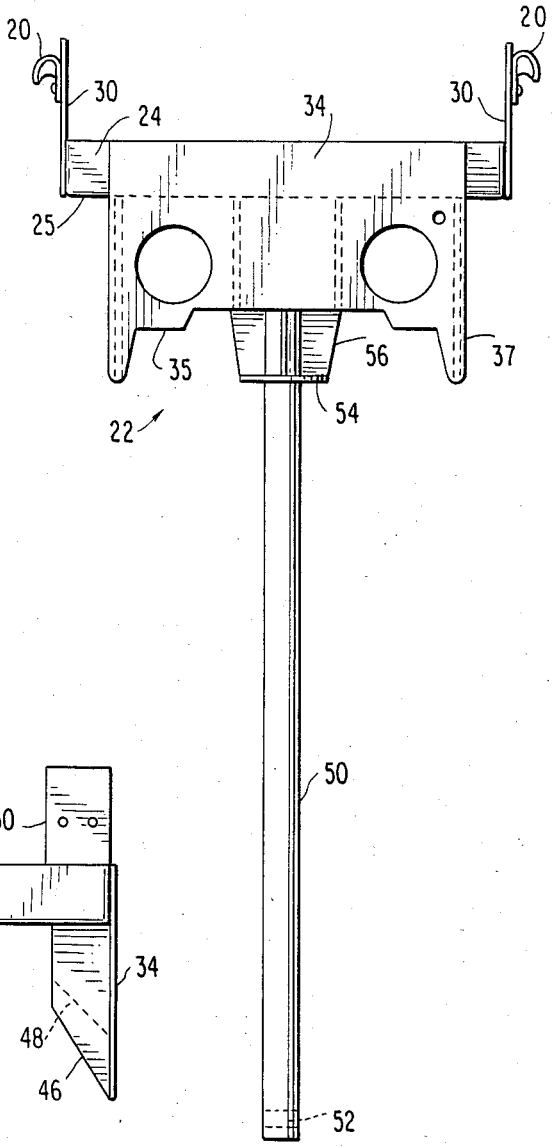
FIG. 5 is a rear view in elevation of the embodiment of FIG. 3.
Figure 6:
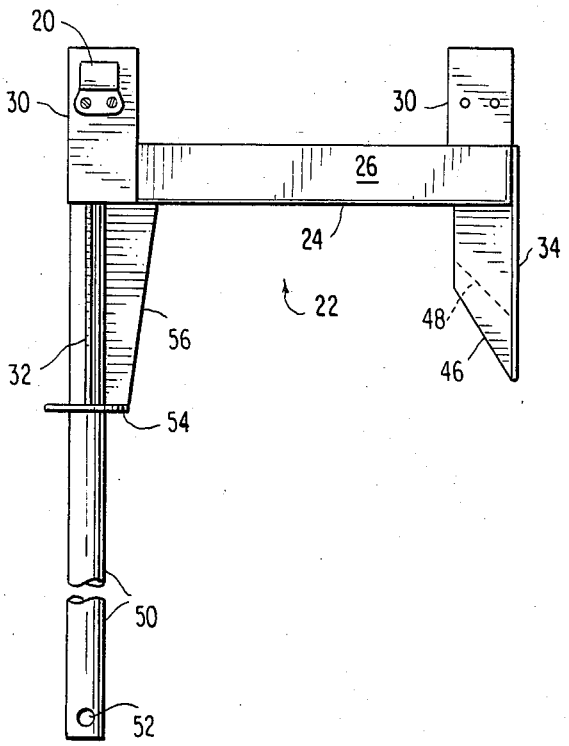
FIG. 6 is a side view in elevation of the embodiment of FIG. 3.
Figure 9:
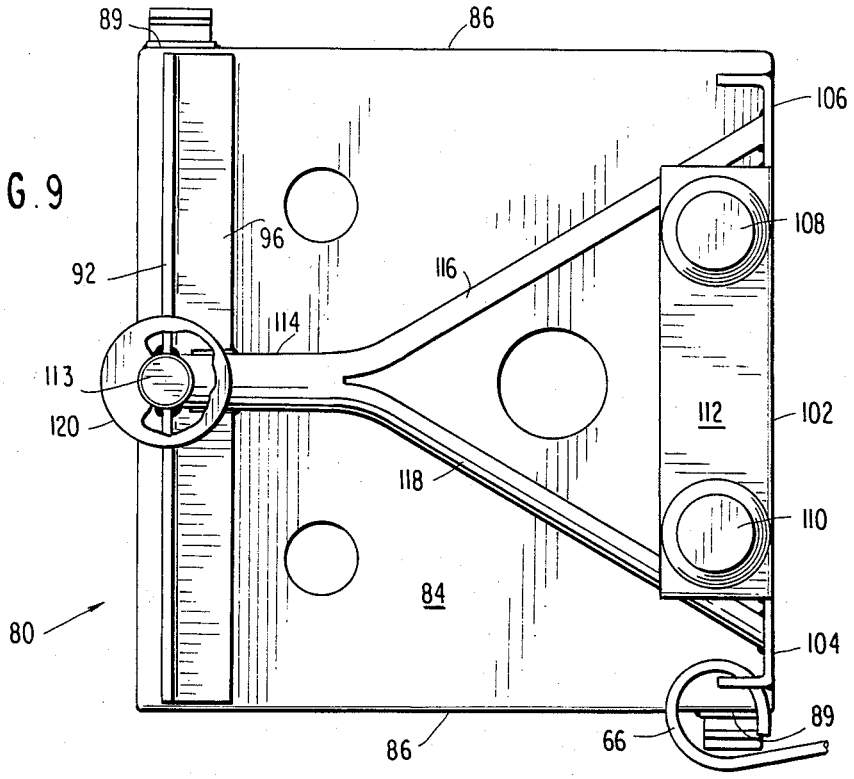
FIG. 9 is a bottom view of the mount of FIG. 7.

As seen in FIG. 3, the plastic coated steel cable 23 having a thimble formed at each of its ends is threaded through a hole in rear bracket 34. Since the thimbles are larger than the diameter of the hole in rear bracket 34, preventing the cable from becoming detached from the support, an uncrimped end of cable 23 is drawn through the hole and crimped afterwards. This cable is provided for securing the supporting frame in place on the coupler in the manner described above.

In addition, there is shown in FIG. 3 a shock cord or bungee 64 which is used to support the end of a brake hose or pipe 138, as shown in FIG. 2. Hooks 66 which may be crimped are provided at the ends of bungee 64. The bungee is attached to rear bracket 34 by inserting an open end of a hook 66 in a hole in bracket 34 and then crimping it. The hook at the other end of bungee 64 is similarly attached to the brake pipe.

A second embodiment of the supporting frame of the mount is shown in FIGS. 7 through 11A. The supporting frame of this second embodiment is generally indicated by reference numeral 80 and encompasses tray 82 which resemebles tray 24 described above in that it has a bottom 84 with lightening (or drain) holes and side walls 86, one of which 87 is provided with a cut-out 88 to accomodate handle 11 so that the battery pack 10 can be firmly seated in the tray. Tray 82 also has diametrically opposed vertical posts 89 with the hook portions 20 of latches 16 attached thereto.

The front and rear mounting brackets of this embodiment of the top of coupler mount differ from those described above and are intended to provide a mount which is not only rigid and strong, but also has improved shock absorbing characteristics. (The convention explained above regarding the designation of brackets as front and rear is employed.) Front and rear brackets are designated 92 and 94, respectively, and are attached to the underside of the bottom 84 of tray 82 and extend substantially along the whole length of their respective bottom edges of the tray. The brackets provide contact with the top and sides of the coupler to insure that the coupler mount can be seated firmly on top of the coupler.

Figure 10:
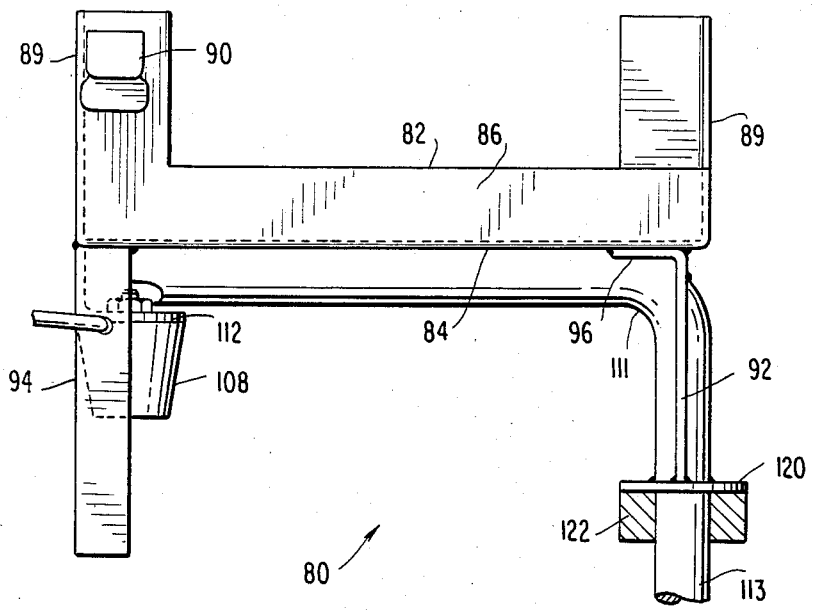
FIG. 10 is a side view in elevation of the mount of FIG. 7.
Figure 11A:
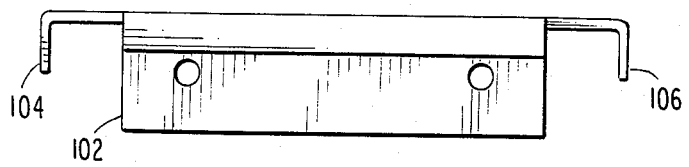
FIGS. 11 and 11A are views showing the details of the rear mounting bracket of the modification of FIG. 7, FIG. 11 being a front elevation and FIG. 11A being a top plan view.
Figure 11:
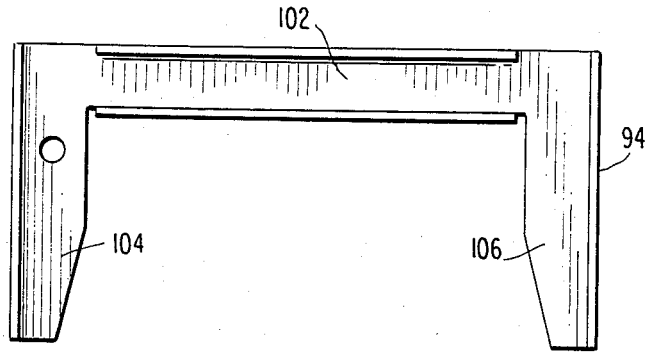

The details of front bracket 92 can be seen best in FIGS. 7 and 10. In vertical cross section, bracket 92 is shaped like an inverted "L", providing a flange 96 by which the bracket is attached to the underside of bottom 84 of tray 82 and a depending leg or web 98 having a U-shaped cut-out 100. As can be seen in FIGS. 8 and 11, rear bracket 94 has the general appearance in elevation of an unverted "U" when attached to the tray 82. Bracket 94 is shown in detail in FIGS. 11 and 11A as having a channel shaped middle section 102 and downwardly projecting portions 104 and 106, both of the latter being generally L-shaped in horizontal cross section to provide some contact with the surface of the sides of the coupler when the mount is in place. A pair of neoprene shock mounts 108 and 110 having bolts formed integrally therewith are bolted to the lowermost flange 112 of the channel-shaped middle section 102, one of said shock mounts being provided adjacent each end section 102. When the coupler mount is in place, shock mounts 108 and 110 will be in contact with the top surface of the coupler. Securing cable 23 and a shock cord or bungee 64 attached by hook 66 are carried on rear bracket 94 in the manner and for the same purposes as were described above.

Supporting frame 80 also includes an inverted L-shaped rod 111, the downwardly directed leg 113 of which is inserted in the flag hole of the coupler knuckle 36 and projects slightly beyond the bottom of the knuckle. The lower end of leg 113 of rod 111 is provided with a hole to receive a locking device, i.e., a padlock. The upper portion of leg 113 or rod 111 fits in the cut-out 100 in web 98 of front bracket 92 and is fastened to web 98 by welding. To provide rigid support for tray 82, horizontal leg 114 of rod 111 is bifurcated. The ends of bifurcated sections 116 and 118 extend into the opening in channel-shaped middle section 102 of rear bracket 94 and are welded to that section of the bracket. A steel washer 120 welded to both rod 111 and web 98 serves to retain the rod in place in the cut-out 100 in the web. A shock absorbing neoprene washer 122 fits tightly on rod 111 under the steel washer 120 in position to contact the top surface of the coupler knuckle when rod 111 is in place in the flag hole of the knuckle.

Figure 13:
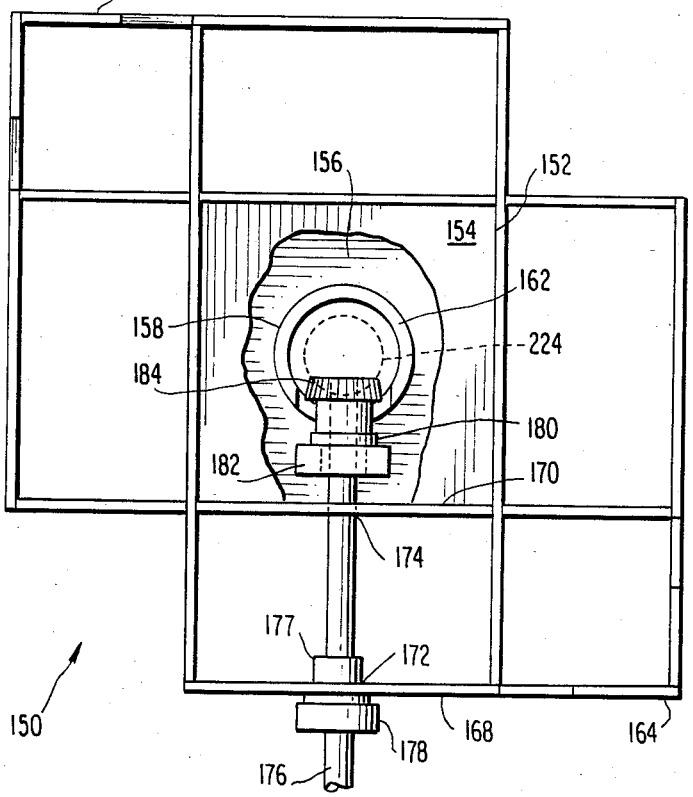
FIG. 13 is a top plan view of the embodiment of FIG. 12 with some parts broken away and others being represented by dotted lines.
Figure 12:
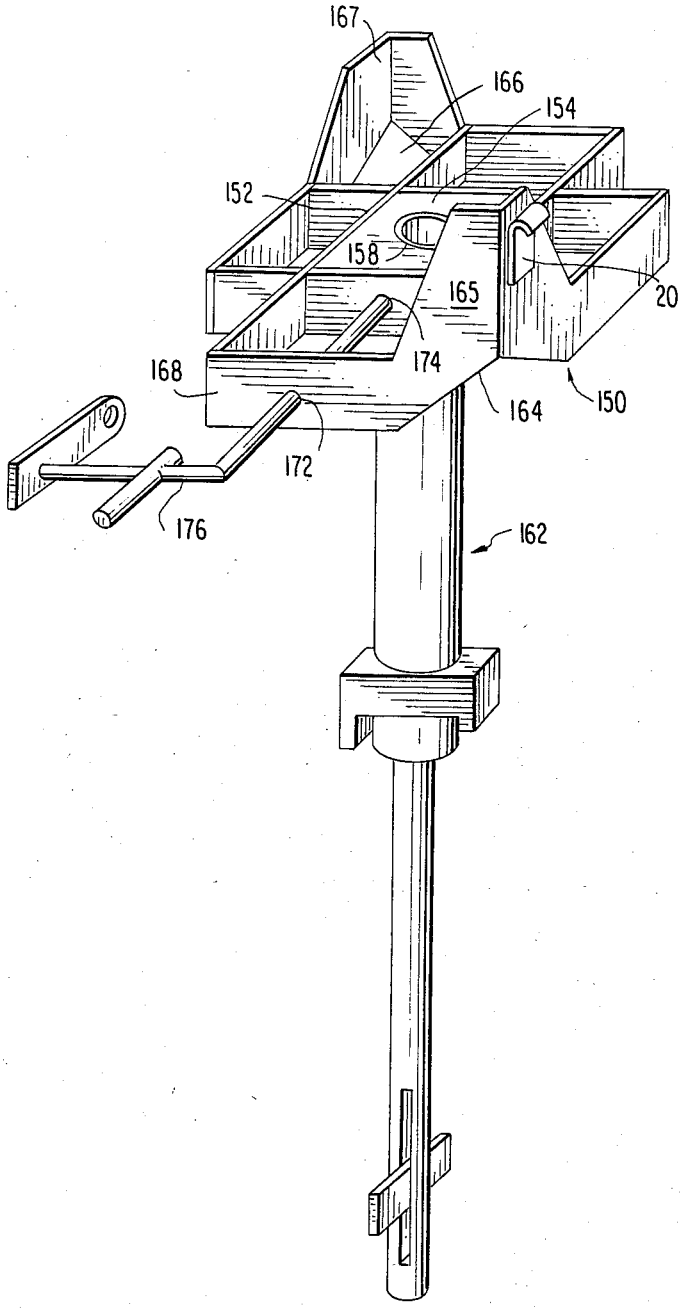
FIG. 12 is a diagrammatic view of a third embodiment of the coupler mount with the battery pack and transmitter unit removed.

A third embodiment of the top of coupler mount of this invention is shown in FIGS. 12 through 15A. One of the primary features of this third embodiment is the ease with which it can be secured firmly in place on a coupler knuckle. As can be seen in FIGS. 12 and 13, the top of the coupler mount of this embodiment comprises a strong but lightweight tray generally indicated at 150 which resembles a grate or gridlike structure made up of a number of cells. The central grid or cell 152 has flat rectangular plates 154 and 156 flush mounted in its top and bottom openings, respectively, providing a smooth and even top and bottom surface. Central openings 158 and 160 are provided in plates 154 and 156, respectively, to receive the upper end of a cylindrical mounting post generally indicated 162 which supports tray 150. The side plates at diametrically opposed corners 164 and 166 have upstanding projections 165 and 167, respectively, shaped to receive the corresponding corners of the mated battery pack 10 and transmitter 12. Hooks 20 which are part of the hold down arrangement provided by the draw pull type latches previously described are also used with this embodiment of the invention and are attached to projections 165 and 167.

Bars of plates 168 and 170 of tray 150 have holes 172 and 174, respectively, in which a crank 176 is rotatably mounted. A nylon bearing 177 is pressed in the hole 172 in bar 168 to support the crank 176 at that point and a thrust collar 178 is provided to assist in preventing any lateral movement of the crank 176. A second nylon bearing 180 carried in a mounting block 182 near the inner end of crank 176 supports the crank at that point. The mounting block is attached to plates 154 and 156 of the central grid 152 of tray 150. Bevel gear 184 is provided at the innermost end of the crank 176 and is held in place on the crank in customary fashion by a keyway and set screw.

As was explained above but is more clearly shown in FIG. 14, the upper end of vertical mounting post 162 is received in openings 158 and 160 in plates 154 and 156, respectively, which are flush mounted in central cell 152 of tray 150. Post 162 has a large diameter central recess or opening 182 at its upper end and a central bore of different diameters extending throughout the rest of its length. Bore 184 in the main body 186 of post 162 slidably receives the upper end of a shaft 188. The bore 190 opening at the bottom of recess 182 has a reduced diameter to receive a press fitted nylon bearing 192. The bore is further reduced at 194 to provide shoulders against which bearing 192 and the upper end of shaft 188 rest, the latter occuring when the shaft is in its retracted position. Thus, the shoulders provided by the bore at 194 provide a stop for shaft 188.

The bore is enlarged again at 195 to provide a recess or opening in which to provide a recess or opening in which a washer 196 is fitted. Washer 196 has a flat indicated at 198 which contacts the adjacent area of a flat 200 milled on the surface of shaft 188. This arrangement prevents rotation of shaft 188 while permitting it to slide in the bore in post 162. To enable the washer 196 to be inserted in the bore enlargement at 194 during fabrication of the mount, the washer is made in two essentially semi-circular halves.

A generally rectangularly shaped bearing block 202 having a central hole 204 and a downturned lip 206 fits over the lower end of post 162 and is welded thereto. The lip 206 fits snugly over a raised edge 205 on the top surface of a knuckle (see FIG. 2). A neoprene washer 208 is pressed along shaft 188 into the opening 204 in block 202 and is bonded to the surface at the bottom of post 162.

An elongated slot 212 is formed in shaft 188 near its lower end, along the centerline of the shaft 188. A locking bar 214 is mounted on a shaft 216 in slot 212 so that it can pivot in and out of the slot. The fabrication of slot 212 is accomplished by removing a chord shaped segment 218 from the shaft 188, as by making a saw cut along the shaft. Slot 212 is then made in shaft 188 by milling or otherwise removing enough of the shaft 188 to provide the slot opening 212, taking care however to leave enough material to form the shaft 216 for pivotably mounting the locking bar 214. The chord shaped segment 218 is then welded back into place. This fabrication process provides a sturdy shaft 216 since it is retained as an integral part of shaft 188.

It will be recalled from the above description of this embodiment of the invention that shaft 188 is slidably mounted in the bore 184 in main body 186 of mounting post 162 and is held against rotation by the flat surface 198 on washer 196 engaging the flat surface 200 on shaft 188. To cause the shaft 188 to slide vertically in mounting post body 186, a threaded rod 220 is inserted in screw-like fashion in a drilled and tapped hole 222 in shaft 188. The threaded rod 220 is rotatably mounted in bearing 192 and a bevel gear 224 is keyed to rod 220 near its upper end. A retaining nut is screwed onto the end of rod 220. As shown in FIG. 13, the bevel gear 184 on the end of crank 176 engages the bevel gear 224 on the rod 220 so that the latter can be rotated by turning crank 176 using crank handle 226. Rotation of threaded rod 220 in the threaded hole 222 in shaft 188 will result in extension and retraction of shaft 188 with respect to post 162.

Figure 15:
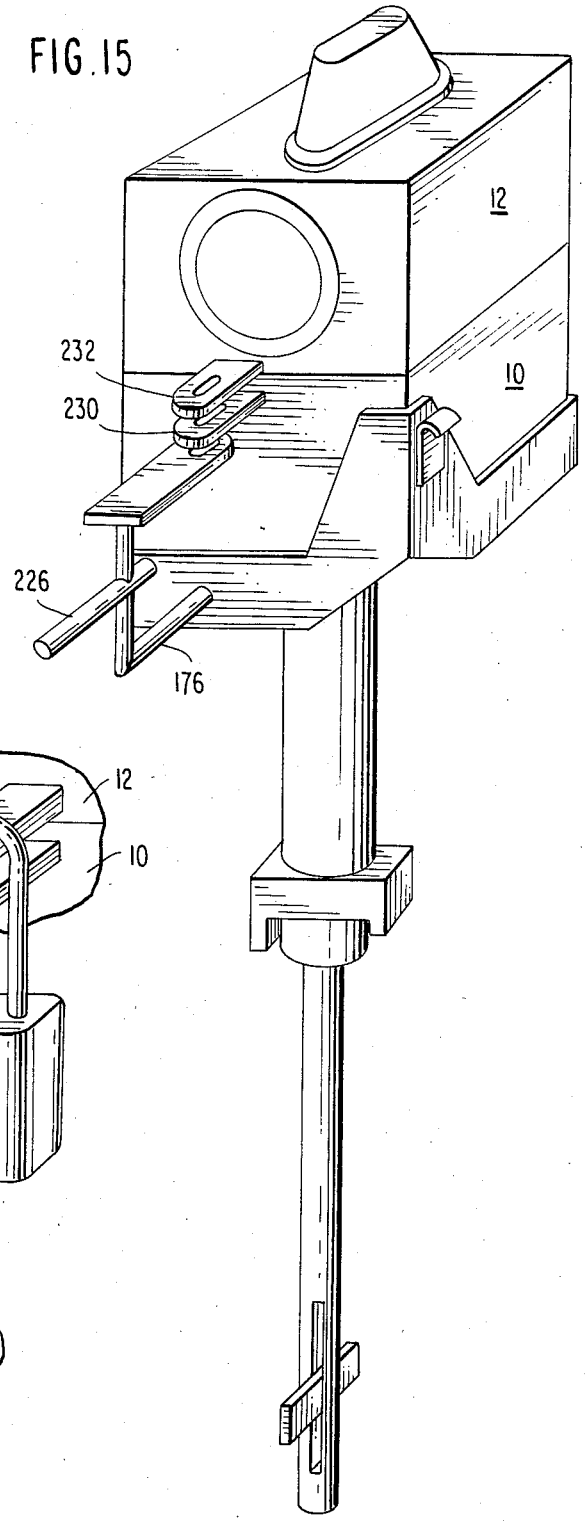
FIG. 15 is a diagrammatic view of the embodiment of FIG. 12 with the transmitter unit and batter, illustrating the manner of locking that embodiment in place.
Figure 15A:
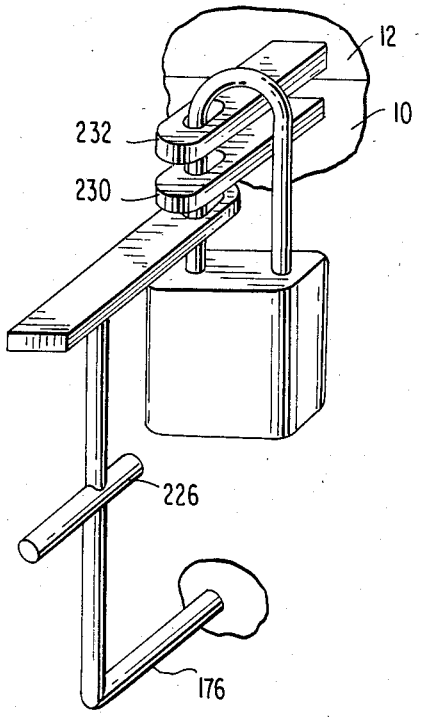
FIG. 15A is an enlarged view showing details of the locking arrangement.

Reference is made to FIGS. 15 and 15A to complete the description of this third embodiment of the invention. Locking dogs 230 and 232 provided on the battery pack 10 and the transmitter unit 12, respectively, will be in superimposed relation as shown and the respective holes in the locking dogs will be in alignment. The assembled package is then set on the coupler knuckle by rotating the locking bar 214 into slot 212 so that extended shaft 188 can be inserted through the flag hole in the coupler knuckle. The bearing block 202 and neoprene washer 208 attached to the foot of mounting post 162 will rest on the top of the coupler knuckle with the downturned lip 206 on the bearing block engaging the raised edge 205 on the top of the knuckle 36. The locking bar 214 is then rotated out of slot 212 to a horizontal position so that it will engage the underside of the coupler knuckle when crank 176 is rotated, slidably retracting shaft 188 into the bore in mounting post 162. When the assembly is snugly in place on the coupler knuckle, the crank 176 is rotated until the locking bar 234 provided on the crank is directly beneath superposed dogs 230 and 232 and the holes in all three locking parts, 230, 232 and 234, are in alignment. The hasp of a padlock 236 can then be inserted through the aligned holes locking the package in place on the coupler knuckle.

It is to be noted that especially in the case of the third embodiment of the invention, the battery pack and transmitter can be mounted in juxtaposed relationship and provided with locking parts that would interlock with a bar on the crank handle. Such an arrangement would provide a package having a different profile as well as different dimensions from the arrangement of the battery pack and transmitter in stacked relationship described above. The advantage of this alternative arrangement would be where a lower profile is required for proper clearances.

As particularly shown in FIG. 2, when the mount is in place on the coupler of the last car in a train, a hose 38 is connected to the brake air pipe 40. The other end of the hose 38 is connected to fitting on the transmitter unit 12, and the point of connection of the air pipe 40 and hose 38 is supported by a bungee 64. One of the conditions monitored by the transmitter unit 12 is the pressure of brake air pipe 40. This pressure, as well as other data, is transmitted to the locomotive.

As will be appreciated from the foregoing description and the drawing figures, the invention provides for the easy mounting and removal of signalling and monitoring equipment on the coupler of the last car of a railroad train. The unitary package as shown in FIG. 1 is simply set on top of the coupler of the last car of a railroad train. The unitary package is simply set on the top of the coupler and held in place by a rod or shaft projecting through the flag hole in the knuckle of the coupler a prevented from swivelling by engagement with protions of the surface of the coupler.

While the invention has been described in terms of a preferred embodiment for attaching signalling and monitoring equipment to couplers of rairoad cars, those skilled in the art will appreciate that the invention has other applications and that modifications can be made to the invention without departing from the spirit and scope of the appended claims.

Having thus described our invention, what we claim and consider to be novel and desire to secure by Letters Patent is as follows:

1. An attachment for securing railroad signalling and monitoring equipment to the coupler of a railroad car, said coupler having a flag hole in the knuckle thereof, said attachment comprising:

a tray for supporting said equipment; and means attached to said tray for mounting said tray on the top of the coupler so that said equipment will not be damaged in the event that said coupler is engaged by another coupler, said means including a foot portion which rests on the top of the coupler knuckle and prevents swivelling of said tray, and a rod which is designed to be received and locked in said flag hole.

2. The attachment recited in claim 1 further including locking means attached to the end of said rod for retaining said rod in said flag hole.

3. The attachment recited in claim 1 further including hold down means for retaining said equipment on said tray.

4. An attachment for securing railroad signalling and monitoring equipment to the coupler of a railroad car, said coupler having a flag hole in the knuckle thereof, said attachment comprising:

a tray for supporting said equipment;

hold down means for retaining said equipment on said tray;

means attached to said tray for mounting said tray on the top of said coupler so that said equipment is not damaged in the event that another coupler engages said coupler on which said tray is mounted, said mounting means including a foot portion which rests on top of the coupler, and means including an extension received in said flag hole and projecting beyond the bottom of said coupler;

locking means for retaining said extension in said flag hole; and means for preventing said attachment from swivelling on said coupler.

5. The attachment recited in claim 4 wherein said mounting means further includes a bracket attached to said tray, said bracket being shaped to fit on and around complementarily shaped portions of the top and sides of the coupler to prevent said attachment from swivelling when in place on the top of a coupler.

6. The attachment recited in claim 5 wherein said extension received in said flag hole projects beyond the bottom of the coupler, said attachment further comprising means for securing said extension in said flag hole.

7. The attachment recited in claim 6 wherein said means for securing said extension in said flag hole is a padlock.

8. The attachment recited in claim 4 wherein said means attached to said tray is a bracket which includes a rod and said foot portion is a washer carried on said rod.

9. The attachment recited in claim 4 wherein said means attached to said tray for mounting said tray on the coupler is a first bracket which includes an inverted L-shaped rod, said rod having bifurcated portions attached to the underside of said tray.

10. The attachment recited in claim 9 wherein said foot portion includes a shock absorbing washer carried on said L-shaped rod which washer contacts the top of said coupler.

11. The attachment recited in claim 9 wherein a second bracket is attached to the underside of said tray in spaced relation to said first bracket, said second bracket being shaped to fit on and around complementarily shaped portions of the top and sides of the coupler to prevent said attachment from swivelling when in place on the top of a coupler.

12. The attachment recited in claim 11 wherein said second bracket carries shock mounts which contact the top surface of the coupler.

13. The attachment recited in claim 4 wherein said means attached to said tray for mounting said tray on the coupler is a mounting post having a central bore and said extension is the end of a shaft slidably mounted in said bore which, when extended, projects trough said flag hole.

14. The attachment recited in claim 13 including locking means pivotally mounted in a slot provided in said shaft so that said locking means can be rotated into locking position to engage the underside of the coupler knuckle when the shaft projects through said flag hole.

15. The attachment recited in claim 14 including means for slidably moving said shaft in the bore in the mounting post.

16. The attachment recited in claim 15 wherein said means for moving the shaft includes a crank having locking means carried thereon, and said equipment is also provided with locking means, said locking means on said crank being adapted to be positioned in locking relationship with the locking means carried on said equipment when said shaft is in locked position in said flag hole.

17. The attachment recited in claim 13 wherein the top foot portion which rests on top of the coupler is a block carried on the lower end of the mounting post, said block being provided with means for engaging the top surface of the coupler knuckle to prevent said attachment from swivelling when in position on the coupler.

18. A package of railroad signalling and monitoring equipment for mounting on the top surface of a railroad coupler, said coupler having a flag hole in the knuckle thereof, said package comprising:

a battery pack;

a transmitter unit mated with and connected to said battery pack to form an operating unit; and a support frame connected to said operating unit for mounting on the top surface of said coupler, said frame including a tray for receiving said operating unit and means attached to said tray for mounting said tray on the coupler so that said operating unit is not damaged in the event that another coupler engages said coupler, said means including a foot portion which rests on top of the coupler and prevents said tray from swivelling, and an extension designed to be received by and locked in said flag hole.

19. The package recited in claim 18 wherein the end of said extension extends beyond the bottom of said coupler, and means are provided for securing said frame in place on said coupler.

20. The combination recited in claim 18 wherein said operating unit and said tray include mating latching means for securing said operating unit to said frame.

* * * * *